US006675419B2

(12) United States Patent
Rivera

(10) Patent No.: US 6,675,419 B2
(45) Date of Patent: Jan. 13, 2004

(54) REMOVABLE TOOL ELEMENT FOR INCLUSION IN A FOLDING TOOL

(75) Inventor: Benjamin C. Rivera, West Linn, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 62 days.

(21) Appl. No.: 10/066,119

(22) Filed: Jan. 30, 2002

(65) Prior Publication Data

US 2003/0140424 A1 Jul. 31, 2003

(51) Int. Cl.[7] ..... B25B 7/22

(52) U.S. Cl. ..... 7/128; 7/120; 7/118; 7/129; 7/105; 7/165; 81/440

(58) Field of Search ..... 7/128, 118, 120, 7/129, 105, 165; 81/440; 30/162, 355

(56) References Cited

U.S. PATENT DOCUMENTS

| | | | | |
|---|---|---|---|---|
| 187,483 A | | 2/1877 | Rightor | |
| 716,623 A | | 12/1902 | Brouillette | |
| 1,046,361 A | | 12/1912 | Wulff | |
| 1,561,262 A | | 11/1925 | Martin | |
| 2,503,380 A | | 4/1950 | Derby | |
| 2,980,996 A | | 4/1961 | Beran | |
| 4,805,250 A | | 2/1989 | Dugas | 7/118 |
| 4,882,841 A | | 11/1989 | Margolis | 30/125 |
| 5,125,157 A | | 6/1992 | Howard | 30/123 |
| 5,358,297 A | * | 10/1994 | Coleman | 294/99.2 |
| 5,400,451 A | | 3/1995 | Furukawa | 7/106 |
| 5,402,575 A | | 4/1995 | Maxcy | 30/123 |
| 5,553,340 A | | 9/1996 | Brown, Jr. | 7/118 |
| 5,594,966 A | | 1/1997 | Goldman | 7/120 |
| 5,664,274 A | | 9/1997 | Collins | 7/129 |
| 5,711,194 A | | 1/1998 | Anderson | 81/440 |
| 5,809,600 A | | 9/1998 | Cachot | 7/128 |
| 5,927,164 A | | 7/1999 | Anderson | 81/440 |
| D413,499 S | * | 9/1999 | Anderson et al. | D8/34 |
| 6,006,384 A | | 12/1999 | Toal | 7/105 |
| 6,014,786 A | | 1/2000 | Cachot | 7/118 |
| 6,014,787 A | | 1/2000 | Rivera | 7/128 |
| 6,038,723 A | * | 3/2000 | Nabors et al. | 7/128 |
| 6,047,619 A | | 4/2000 | Anderson | 81/440 |
| 6,082,232 A | | 7/2000 | Anderson | 81/440 |
| 6,085,620 A | | 7/2000 | Anderson | 81/440 |
| 6,101,654 A | | 8/2000 | Cachot | 7/128 |

(List continued on next page.)

FOREIGN PATENT DOCUMENTS

| | | |
|---|---|---|
| EP | 0 771 622 A1 | 5/1997 |
| FR | 2 760 955 | 9/1998 |
| WO | WO 97/19787 | 6/1997 |

OTHER PUBLICATIONS

U.S. patent application Ser. No. 09/837,139, Rivera, filed Apr. 17, 2001.

*Primary Examiner*—Lee D. Wilson
*Assistant Examiner*—Alvin J Grant
(74) *Attorney, Agent, or Firm*—Chernoff, Vilhauer, McClung & Stenzel, LLP

(57) ABSTRACT

A folding multipurpose tool includes removable tweezers. The tweezers have a pair of opposed legs that are hooked over a pin extending through a tool storage pocket in a handle of the tool. The tweezers can pivot about said pin between a folded position within said pocket and an extended position outside of said pocket. One of the legs is thicker than the other and unable to pass through a passageway between the pin and the floor of the tool pocket. When the tweezers are in the extended position one of the legs may be slid into the pocket, disengaging the tweezers from the pin and enables the tweezer to be lifted out of the pocket. A generic implement with a hooked shaped base may be removed from a tool pocket in a similar manner.

14 Claims, 3 Drawing Sheets

U.S. PATENT DOCUMENTS

| | | | | | |
|---|---|---|---|---|---|
| 6,105,189 | A | * | 8/2000 | Nabors et al. | 7/128 |
| 6,119,561 | A | | 9/2000 | Anderson | 81/440 |
| 6,131,222 | A | | 10/2000 | Anderson | 7/105 |
| 6,145,851 | A | | 11/2000 | Heber | 279/143 |
| 6,182,541 | B1 | | 2/2001 | Anderson | 81/440 |
| 6,216,301 | B1 | | 4/2001 | Rivera | 7/128 |
| 6,243,901 | B1 | | 6/2001 | Elsener | 7/118 |
| 6,257,106 | B1 | | 7/2001 | Anderson | 81/440 |
| 6,273,582 | B1 | | 8/2001 | Taggart | 362/119 |
| 6,279,186 | B1 | | 8/2001 | Ge et al. | 7/165 |
| 6,286,397 | B1 | | 9/2001 | Taggart | 81/63.1 |
| 6,298,756 | B1 | | 10/2001 | Anderson | 81/440 |
| 6,314,600 | B1 | | 11/2001 | Cachot | 7/128 |
| 6,318,218 | B1 | * | 11/2001 | Anderson et al. | 81/440 |
| 2001/0014986 | A1 | | 8/2001 | Harrison | 7/128 |

* cited by examiner

REMOVABLE TOOL ELEMENT FOR INCLUSION IN A FOLDING TOOL

BACKGROUND OF INVENTION

This invention relates to removable implements for folding tools or knives.

A number of tools or knives have removable implements. Various techniques are employed for stowing and removing these implements. Probably the most common arrangement is to provide the handle of the tool with a simple pocket or recess to receive the implement. The implement may be retained in the pocket by a spring, latch, or merely an interference fit. The removable toothpick of the Swiss Army Knife is probably the most familiar example of this arrangement. Other examples of removable implements stowed in this fashion are disclosed in U.S. Pat. Nos. 4,815,250, 5,125,157, and 5,594,966. Another common device is a foldable, removable or extensible sleeve or socket which stores multiple tool bits such as disclosed in U.S. Pat. Nos. 6,298,756 and 6,119,561. A removable magazine for storing multiple tool bits is disclosed in U.S. Pat. No. 6,314,600. A pivotable carrier blade to which multiple removable tool bits are attached is disclosed in U.S. Pat. No. 6,014,786. Removable pliers are disclosed in U.S. Pat. No. 5,664,274 and in Patent Application Publication No. US 2001/0014986 A1. Some knives with replaceable blades use a keyhole slot in the base of the blade to removably attach the blade to the knife.

BRIEF SUMMARY OF THE INVENTION

The present invention provides a new configuration of a foldable removable implement for a folding tool or knife, and a novel method for removing and replacing the implement in the tool or knife.

DETAILED DESCRIPTION OF THE PREFERRED EMBODIMENTS

Figure 1:
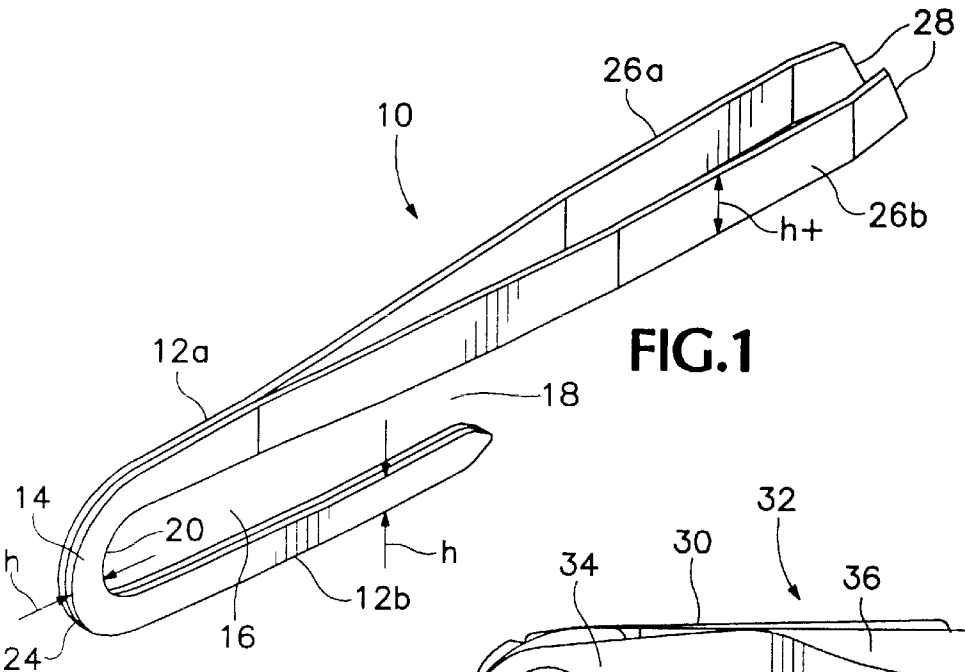
FIG. 1 is an isometric view of removable tweezers.

FIG. 1 shows a pair of tweezers 10 that is being used as an example of a removable implement for the purpose of explaining the invention. However, the invention is not peculiar to tweezers and it should be understood that other implements, including but not limited to screwdrivers, awls, pencils, toothpicks, files and the like are intended to be represented by the exemplary tweezers.

The exemplary tweezers include a pair of elongate, opposed, substantially parallel legs 12*a* and 12*b*, joined by a base 14. The opposed legs and the base define an elongate slot 16. The slot has an open end 18 and a closed end 20 proximate the base. The back 24 of the base 14 comprises a smooth curved transition between legs 12*a* and 12*b*. The working end of the tweezers also includes a pair of operable spaced apart arms 26*a* and 26*b* with respective tweezer tips 28. In FIG. 1 it can be seen that the open end of the slot faces in a direction that is substantially aligned with the elongate legs.

Figure 2:
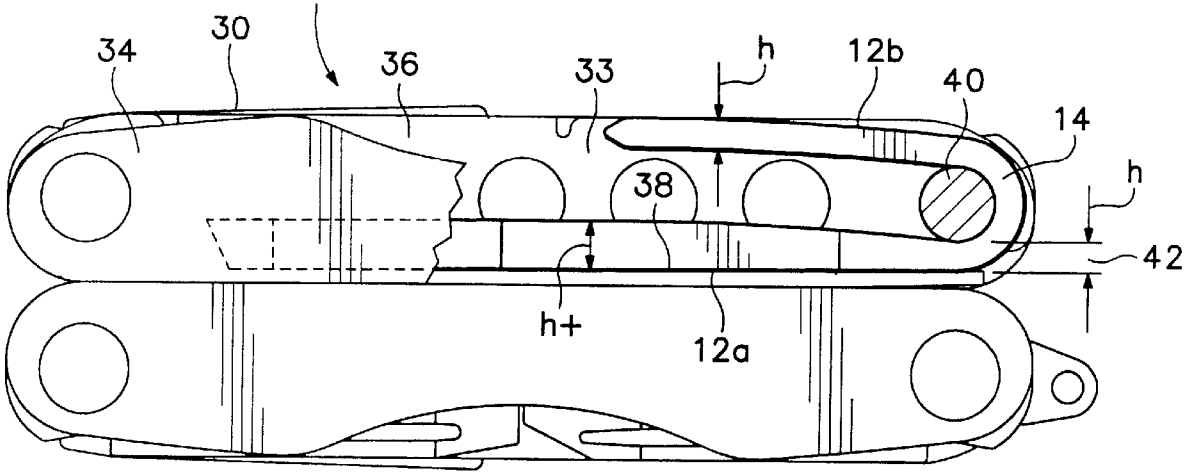
FIG. 2 is a partially cut away side view of a multipurpose tool showing the tweezers of FIG. 1 folded in one handle of a multipurpose tool.

As shown in FIG. 2, the tweezers are stowed in folded position in an elongate handle 30 of a multipurpose tool 32. The side scale 34 of handle 30 has been broken away to show the tweezers 10 in folded position in an elongate tool pocket 33. The pocket in this embodiment is defined by the side scale 34, an interior frame member 36, and a pocket floor 38, which in this case is a part of the frame of handle 30. A cylindrical pivot pin 40 is located at one end of the pocket and extends transversely through the pocket. Foldable tool blades, tool bits, scissor blades, or plier heads, none of which are clearly shown, may be mounted upon or engaged by the pivot pin.

In FIG. 2, the tweezers 10 are shown in engagement with pin 40. Specifically, the tweezers are positioned in the pocket such that the pin 40 is fully received in the slot 16, nestled in the closed end 20 of the slot. The open end 18 of the slot faces the interior of the pocket 33. The end of the pocket that is proximate pin 40 is open and the back 24 of the base 14 faces outwardly from the pocket.

A clearance space 42 is defined between the pin 40 and the pocket floor 38. As viewed in FIG. 2, the clearance space 42 has a height "h," leg 12*a* has a height "h+," and leg 12*b* has an approximate height "h." In view of these dimensions, it can be understood that tweezers 10, while in the folded position as shown in FIG. 2 may not be disengaged from pin 40 and removed from the pocket because the height h+ of leg 12*a* will not pass through the clearance space 42.

Figure 3:
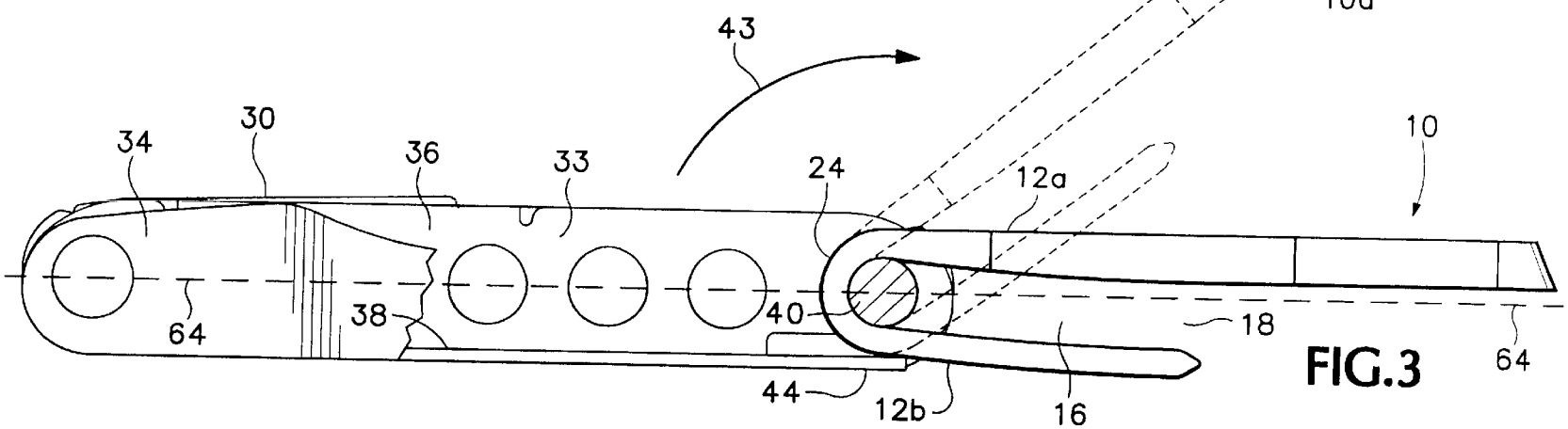
FIG. 3 is a partially cut away side view of the handle of FIG. 2 showing how the tweezers are moved from folded position to extended position.

Turning to FIG. 3, the tweezers 10 are shown in extended position with respect to the handle 30. Pin 40 is still nestled in the closed end 20 of slot 16, but now the open end 18 of the slot faces away from the pocket 33 while the back 24 of the base 14 faces toward the interior of the pocket 33. In extended position, the elongate tweezers 10 and the elongate legs 12*a* and 12*b* extend away from the pocket in the same direction as, and are substantially aligned with, an imaginary axis 64 defined by the elongate pocket 33. The open end 18 of said slot 16 also faces in a direction substantially aligned with the imaginary axis. The arrow 43 and phantom tweezers 10*a* show how the tweezers are rotated from the folded position shown in FIG. 2 to the extended position shown in FIG. 3.

Figure 4:
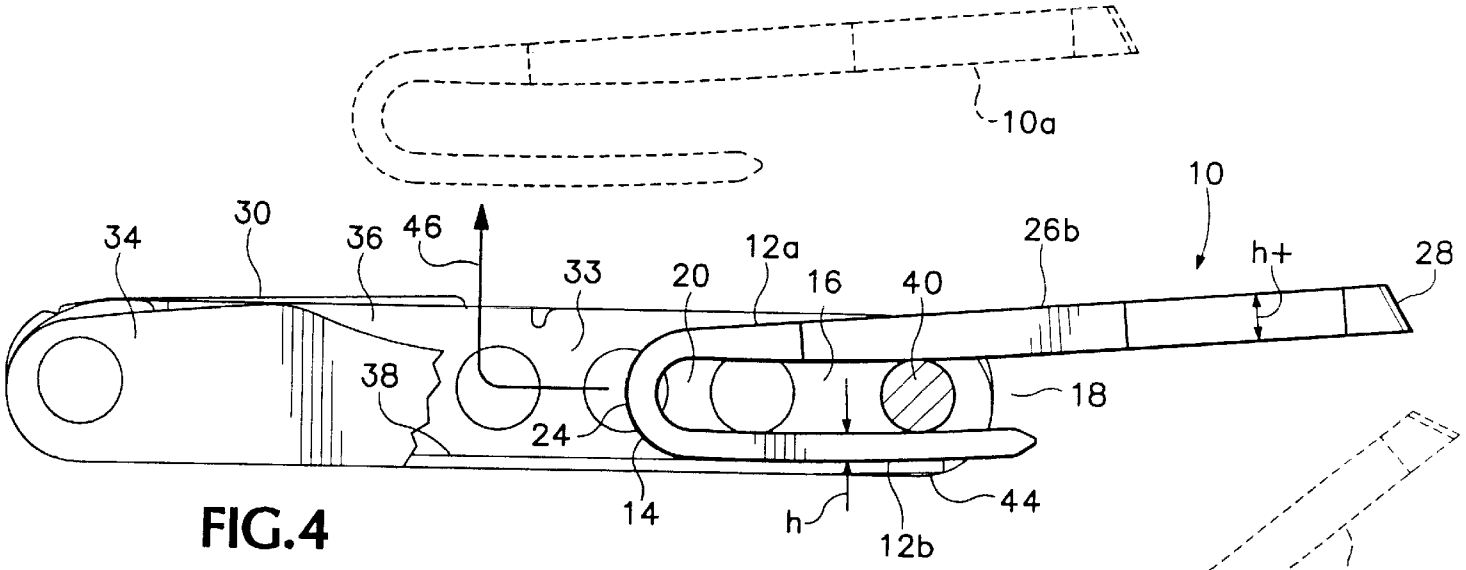
FIG. 4 is a partially cut away side view of the handle of FIGS. 2 and 3 showing how the tweezers may be removed from the handle.

FIG. 4 shows the tweezers being slid from the extended position shown in FIG. 3 into pocket 33 and out of engagement with pin 40. As the tweezers are slid into the pocket, tweezer leg 12*b* passes through the clearance space 42 and the pin 40 exits the open end 18 of the slot 16, disengaging the tweezers from the pin. Once free of the pin, the tweezers may be lifted out of the pocket as shown by arrow 46 and phantom tweezers 10*a*. The tweezers may be slid into the pocket from the extended position because of the height "h" of leg 12*b* being approximately equal to the height "h" of the clearance space 42.

Returning to FIG. 3, a spring 44 is located at the end of pocket floor 38 near pin 40. In this embodiment spring 44 happens to be a leaf spring integral with the pocket floor, but other types of springs could work also. While a spring is not necessary, it can be beneficial. For example while in folded position, the pressure of spring 44 upon the base 14 of the tweezers 10 prevents the tweezers from rotating inadvertently out of the pocket 33. Further, as the tweezers are being pivoted between folded and extended positions, the pressure that the spring applies to the back 24 of the base 14 provides friction and substantially prevents the tweezers from flopping from one position to the other. The back of base may have a cammed surface similar to the base of a conventional knife blade to enhance the control provided by the spring.

However, since the base must pass through clearance space 42 as the tweezers are rotated between folded and extended positions, the distance between the back 24 of the base 14 and the closed end 20 of the slot 16 should not be substantially more than "h." When the tweezers are in extended position as shown in FIG. 3, the pressure of the spring on leg 12*b* prevents the tweezers from inadvertently sliding into the pocket 33 and becoming disengaged from the pin 40. Pushing the tweezers toward the pocket while they are in extended position can provide sufficient force to overcome the spring and cause leg 12*b* to slide through clearance space 42. While the critical dimension of leg 12*b* and base 14 has been described as "h," the same dimension as the clearance space, the spring 44 actually enables the dimension of leg 12*b* and base 14 to be slightly greater than "h" since deflection of the spring will permit a slightly larger leg or base to pass through the clearance space. However, the spring 44 should not be so flexible as to easily permit leg 12*a* having a height of "h+" to pass through the clearance space.

Referring back to FIG. 1, the arms 26*a* and 26*b* are sprung apart as is typical in tweezers. When the tweezers are in folded position in pocket 33, the arms press outwardly against the sides of the pocket, also tending to keep the tweezers from flopping out of the pocket.

The method for removing the tweezers 10 from engagement with the pin 40 in tool storage pocket 33 of handle 30 includes rotating the tweezers from a folded position within the pocket as shown in FIG. 2 to an extended position outside the pocket as shown in FIG. 3 with the open end 18 of the slot 16 facing axially away from the pocket, then sliding the tweezers into the pocket until the pin is outside of the slot and the tweezers are disengaged from the pin, and then lifting the tweezers out of the pocket.

To reinstall the tweezers 10 in the handle 30, place the tweezers in pocket 33 with the open end 18 of the slot 16 facing the pin 40, slide the tweezers toward the pin until the pin is fully received in the slot and the tweezers are in the extended position, and then rotate the tweezers from the extended position to the folded position within the pocket.

Figure 5:
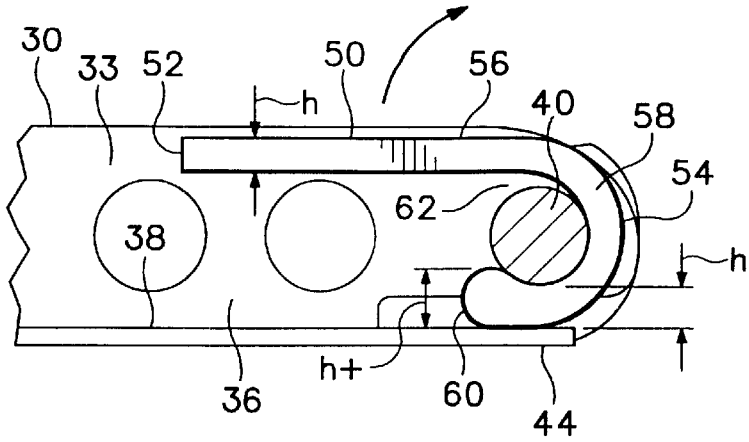
FIG. 5 is a partially cut away side view of a handle showing a generic implement in folded position.
Figure 6:
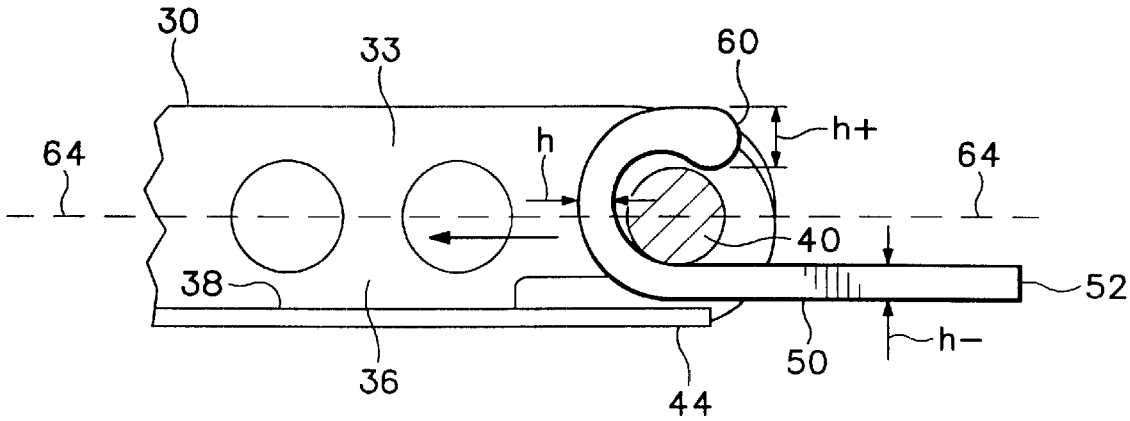
FIG. 6 is a partially cut away side view of the handle of FIG. 5 showing the generic implement in extended position.
Figure 7:
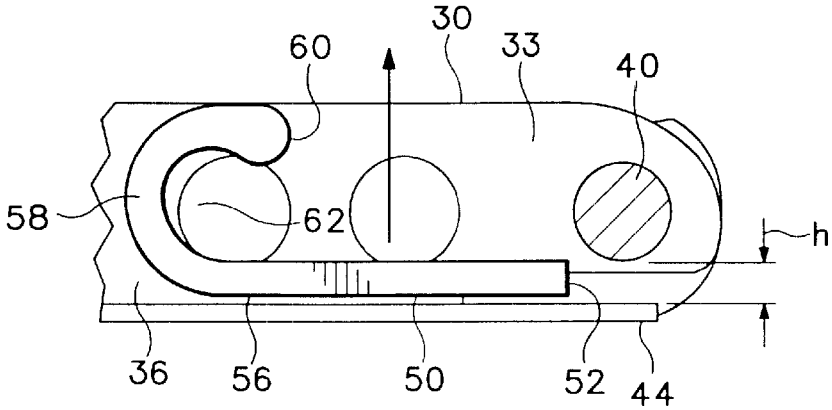
FIG. 7 is a partially cut away side view of the handle of FIGS. 5 and 6 showing how the generic implement may be removed from the handle.

Turning to FIGS. 5–7, an alternative embodiment of a removable implement 50 is shown. In this case implement 50 is generic and could represent a pin, awl, pen, screwdriver, or the like. While the tweezers 10 are shown in FIG. 2 folded in the pocket with the working portion of the tweezers, i.e., the arms and tips, positioned in the lower portion of pocket 33, FIGS. 5–7 demonstrate that this arrangement is not necessary. In FIG. 5, the removable implement 50 has a working portion 52 in the upper portion of pocket 33 when in the folded position. FIGS. 5–7 also demonstrate that the legs 12*a* and 12*b* in FIGS. 1–4 do not have to be elongate, nor does the slot 16.

The generic implement shown in FIG. 5 has a hooked base 54 having a shaft 56, a belly 58 and a tip 60, with the tip substantially opposed to the shaft. The shaft 56 is elongate and includes the working portion 52 of the implement. In FIG. 5, the implement is shown folded within pocket 33 of tool handle 30. The pin 40 is received in the notch 62 formed in the belly 58 of the hooked base 58, by the opposed shaft 56 and tip 60. Pocket 33 has a floor 38 including a spring 44. In folded position the open portion of the hook faces toward the pocket.

As with the tweezers, the clearance space 42 between the pin and the spring 44 has a height "h." However, in this embodiment, the shaft 56 and belly 58 of the hooked base have a height "h−" that is slightly less than the clearance space. The tip 60 of the hook has a height "h+" and cannot easily pass through clearance space 42, even if spring 44 flexes to slightly enlarge the clearance space 42.

Thus, in folded position shown in FIG. 5 the implement is substantially prevented from moving axially with respect to handle 30 by the hooked base on one side of the pin and the enlarged tip 60 on the other side of the pin.

However, as shown in FIG. 6, when the implement 50 is rotated out of pocket 33 into an extended position with the open side of the hook facing away from the pocket, the shaft 56, having a height "h−" slightly less than the clearance space 42, may pass through the clearance space enabling the implement to slide into the pocket and disengage from the pin. Once in the pocket with the shaft 56 clear of the pin, the implement may be removed from the pocket.

As may be seen in FIGS. 5 and 6, when the pin 40 is in the belly 58 of the hooked base 54, there is some space between the pin and the base. This space, approximately equal to or greater than the difference between h and h+, enables the enlarged tip 60 of the hooked base to clear the pin as the implement 50 is being slid into the pocket 33.

The method for removing and replacing implement 50 in the handle 30 of tool 32 is substantially the same as described above with regard to the tweezers.

Although the embodiments shown and described herein show implements that are removably stowed in one of two handles of a multipurpose tool, the invention is equally applicable to a knife or tool having one handle.

Further, while the implements are shown herein as being removed for use, it should be apparent that some removable implements, such as tweezers, may also be used while still installed in the tool in extended position.

Although the embodiments are shown with slots, notches or bellies having smooth arcuate inner surfaces that substantially match the exterior surface of the pivot pin, this configuration is not necessary. For example, a slot, notch or belly in the shape of a "v" would also receive and position the implement in the tool with respect to the pin.

Further, although the legs of the implements are shown herein as being as parallel, extending in the same direction, legs that are not parallel but merely extend away from the pocket in the same general direction as the axis may also be employed.

What is claimed is:

1. A folding tool comprising:

(a) an elongate removable implement;

(b) an elongate tool storage pocket capable of receiving said implement, said elongate tool storage pocket defining a first axis;

(c) a pin associated with said tool storage pocket about which said implement can pivot between a folded position substantially within said pocket and an extended position at least partially outside of said pocket and extending away from said pocket in the same general direction as said first axis; and (d) said implement having a base with first and second opposed parallel legs defining a notch therebetween, said notch having an open side and being capable of receiving and engaging said pin therein, said open side of said notch facing substantially axially out of said pocket when said implement is in said extended position and said implement being removable from said tool by sliding said implement relative to said pin to a position where one of said parallel legs is clear of said pin.

2. A folding tool according to claim 1 wherein said open side of said notch faces substantially axially into said pocket when said implement is in said folded position.

3. A folding tool according to claim 1 wherein said removable implement is slidable within said tool storage pocket and with respect to said pin when said open side of said notch faces substantially axially out of said pocket.

4. A folding tool according to claim 1 wherein one of said opposed parallel legs is elongate, said elongate leg being substantially aligned with said axis when said implement is in said extended position.

5. A folding tool according to claim 1 wherein said implement is disengagable from said tool when in said extended position.

6. A folding tool according to claim 1, said tool storage pocket including a floor with an integral leaf spring, said leaf spring pressing on said base of said removable implement and preventing said implement from sliding inadvertently with respect to said pin.

7. A folding tool according to claim 1 wherein said pocket includes a floor, said floor and said pin defining a passageway through which a portion of said implement must pass into said pocket to disengage said implement from said pin.

8. A method for disengaging an implement from a folding tool of the type having a tool storage pocket with a floor and a pivot pin about which said implement can pivot between a folded position substantially within said pocket and an extended position at least partially outside of said pocket, said method comprising:

(a) providing said implement with a hooked base having an open side capable of receiving and engaging said pin;

(b) arranging said implement in a folded position within said pocket with said pin received within said open side of said hooked base, said open side facing said pocket;

(c) pivoting said implement about said pin to said extended position such that said open side of said hooked base faces away from said pocket; and (d) sliding said implement along said floor and into said pocket until said implement is disengaged from said pin.

9. A method according to claim 8 wherein said pin and said floor define a passageway, said method including sliding at least a portion of said implement into said pocket through said passageway.

10. A method for stowing an elongate implement in a folding tool of the type having a tool storage pocket with a floor and a pivot pin about which said implement can pivot between a folded position substantially within said pocket and an extended position at least partially outside said pocket, said method comprising:

(a) providing said implement with a hooked base having an open side, said open side being capable of receiving and engaging said pin;

(b) positioning said implement in said tool storage pocket adjacent said floor and with said open side of said hooked base facing said pin;

(c) sliding said implement along said floor toward said pin, until said pin is received in said open side of said hooked base and said implement is in said extended position with respect to said pocket; and (d) pivoting said implement about said pin until said implement is in said folded position, substantially within said pocket.

11. A method according to claim 10 wherein said method includes sliding at least a portion of said implement out of said pocket through a passageway defined by said floor and said pin.

12. A method according to claim 10 wherein said method includes pivoting said implement until said open side of said base faces into said pocket.

13. An elongate removable implement for inclusion in a folding tool, comprising:

(a) a base having first and second opposed parallel portions defining a slot therebetween, said slot having an opening; and (b) said first portion including an elongate first leg defining a first axis, said opening facing in a direction substantially aligned with said first axis.

14. An implement according to claim 13, said second portion including an elongate second leg extending from the base in the same general direction as said first leg.

* * * * *